US008776313B2

(12) United States Patent
Wu

(10) Patent No.: US 8,776,313 B2
(45) Date of Patent: Jul. 15, 2014

(54) STATIONERY TOOL

(75) Inventor: Chien-Lung Wu, Chang Hua (TW)

(73) Assignee: SDI Corporation, Chang Hua (TW)

( * ) Notice: Subject to any disclaimer, the term of this patent is extended or adjusted under 35 U.S.C. 154(b) by 312 days.

(21) Appl. No.: 13/326,842

(22) Filed: Dec. 15, 2011

(65) Prior Publication Data

US 2012/0159739 A1 Jun. 28, 2012

(30) Foreign Application Priority Data

Dec. 22, 2010 (TW) ..... 99145260 A

(51) Int. Cl.
*B43K 29/02* (2006.01)
*B43L 19/00* (2006.01)
*B43M 99/00* (2010.01)

(52) U.S. Cl.
CPC ..... *B43L 19/0068* (2013.01); *B43M 99/00* (2013.01)
USPC ..... 15/433; 15/429; 401/52; 401/75; 401/68

(58) Field of Classification Search
CPC ..... B43K 29/02; B43L 19/00; B43L 19/0068; A45D 40/065; A45D 40/06
USPC ..... 15/425, 429–434; 401/52, 68, 75
See application file for complete search history.

(56) References Cited

U.S. PATENT DOCUMENTS

| | | | | |
|---|---|---|---|---|
| 1,725,075 | A | 8/1929 | Henderson | |
| 5,803,637 | A * | 9/1998 | Mitsuya | 401/52 |
| 6,517,272 | B1 * | 2/2003 | Kageyama et al. | 401/92 |
| 2007/0245515 | A1 | 10/2007 | Kadota | |
| 2008/0168617 | A1 | 7/2008 | Hayashi | |

FOREIGN PATENT DOCUMENTS

| | | | |
|---|---|---|---|
| EP | 2103449 | A1 | 9/2009 |
| FR | 702484 | | 4/1931 |
| GB | 284523 | | 2/1928 |
| WO | 2008/146554 | A1 | 12/2008 |

* cited by examiner

*Primary Examiner* — Shay Karls
(74) *Attorney, Agent, or Firm* — patenttm.us

(57) ABSTRACT

A stationery tool has a body and a rubber holding device. The body has a holding end and a holding recess defined in the holding end. The rubber holding device is detachably or securely mounted in the holding recess for holding a rubber to adjust an extension length of the rubber relative to the body and has a clamping segment and a guiding segment. The clamping segment has multiple clamping protrusions for pressing against the rubber. The guiding segment extends outwardly and makes an opening of the rubber holding device have a distance from the clamping segment. Accordingly, the stationery tool has capabilities of adjusting an extension length of the rubber and conveniently replacing a used rubber.

15 Claims, 20 Drawing Sheets

STATIONERY TOOL

BACKGROUND OF THE INVENTION

1. Field of the Invention

The present invention relates to a stationery tool, and more particularly to a stationery tool having a rubber holding device for adjusting an extension length of a rubber and having an ease rubber changing capability.

2. Description of Related Art

Rubbers are mostly block or stick shaped individual objects enabling a user holding the rubber with one hand to wipe pencil writing marks out. To keep a rubber clean, Taiwan Utility Model Patent No. 336548, entitled "Rotation Typed Stick Object Dispenser" is provided. The dispenser of the '548 patent comprises a tubular body containing a stick typed rubber inside, and the rubber can be pushed out of or retracted into the tubular body in a rotation manner. However, the dispenser of the '548 patent is an individual object from other stationery tools, such as pencils or pens, so a user has to alternately use a pencil, a pen, a rubber or a correction tape for writing or drawing. To alternately use different stationery tools is inconvenient; to prepare, carry and store different kinds of stationery tools takes a large space and is also inconvenient.

In addition, Taiwan Utility Model Patent No. 323995, entitled "Dual Purpose Correction Tape", with reference to FIG. 20, discloses a rubber 52 mounted securely on a correction tape body 50. The body 50 has a recess 51 defined in a rear end of the body 50, and the rubber 52 is pressed securely into the recess 51. A cap 53 is detachably mounted on the rear end of the body 50 to hold the rubber 52 inside to prevent the rubber 52 from being dirtied. In use, the correction tape and the rubber 52 can be selectively used by turning the body 50 upside down for convenient usage of the correction tape and the rubber 52.

However, since the rubber 52 is mounted securely on the body 50, as long as deformation of the rubber occurs, the rubber 52 is easily detached from the body 50 when wiping pencil marks out. In addition, the extension length of the rubber 52 cannot be adjusted relative to the body 50 and the rubber 52 cannot be retracted into the body 50, and this is not versatile in use. Furthermore, when the rubber 52 is used up or damaged, the used rubber 52 cannot easily be removed from the body 50 and replaced with a new one.

To overcome the shortcomings, the present invention tends to provide a stationery tool to mitigate or obviate the aforementioned problems.

SUMMARY OF THE INVENTION

The main objective of the invention is to provide a stationery tool having a rubber holding device to securely clamp a rubber and having capabilities of adjusting an extension length of the rubber and conveniently replacing a used rubber.

The stationery tool has a first end for adjustably combining with a rubber and a second end for combining with a stationery element and comprises a body and a rubber holding device. The body has a holding end, a functional end opposite to the holding end and a holding recess defined in the holding end of the body. The rubber holding device is mounted in the holding recess of the body for holding a rubber to adjust an extension length of the rubber relative to the body and comprises an opening and a clamping segment. The opening is defined in the rubber holding device at a position relative to the holding end of the body. The clamping segment is slidably mounted in the holding recess of the body, is slidable between the holding recess and the opening of the rubber holding device to adjust the extension length of the rubber relative to the body and comprises multiple clamping protrusions for pressing against the rubber.

With such an arrangement, the rubber holding device in accordance with the present invention has capabilities of adjusting an extension length of the rubber relative to the body and conveniently replacing the rubber. The rubber can be pushed to extend out of the body for use and can be retracted completely after wiping. As to replacement, the rubber can be easily replaced by drawing the rubber holding device out from the body or rotating the rotating knob, and this is convenient in operation.

In addition, because the rubber holding device has a clamping segment and a guiding segment, the rubber can be securely clamped by the clamping segment to prevent the rubber from detaching from the body. The guiding segment can keep the rubber from being violently deformed during wiping and has capabilities of preventing the rubber from detaching from the body and of absorbing the deformation of the rubber.

Other objects, advantages and novel features of the invention will become more apparent from the following detailed description when taken in conjunction with the accompanying drawings.

DETAILED DESCRIPTION OF PREFERRED EMBODIMENT

The present invention relates to a stationery tool with a rubber holding device. The stationery tool in accordance with the present invention has a holding end provided with a rubber to hold the rubber firmly and a stationery functional end that may be a writing tool, such as a pencil or a pen or an adhesive thin film dispenser, such as a correction tape dispenser or an adhesive tape dispenser. Therefore, the stationery tool in accordance with the present invention has two different kinds of stationery functions for convenient use.

The stationery tool in accordance with the present invention has a body and a holding recess defined in one end of the body. A rubber holding device is mounted in the holding recess and has an opening and a clamping segment. The opening is defined in the rubber holding device at an end outside the body. The clamping segment is slidably mounted in the holding recess of the body, is slidable between the holding recess and the opening of the rubber holding device to adjust the extension length of the rubber relative to the body and comprises multiple clamping protrusions for pressing against the rubber for holding a rubber to adjust an extension length of the rubber relative to the body.

Figure 1:
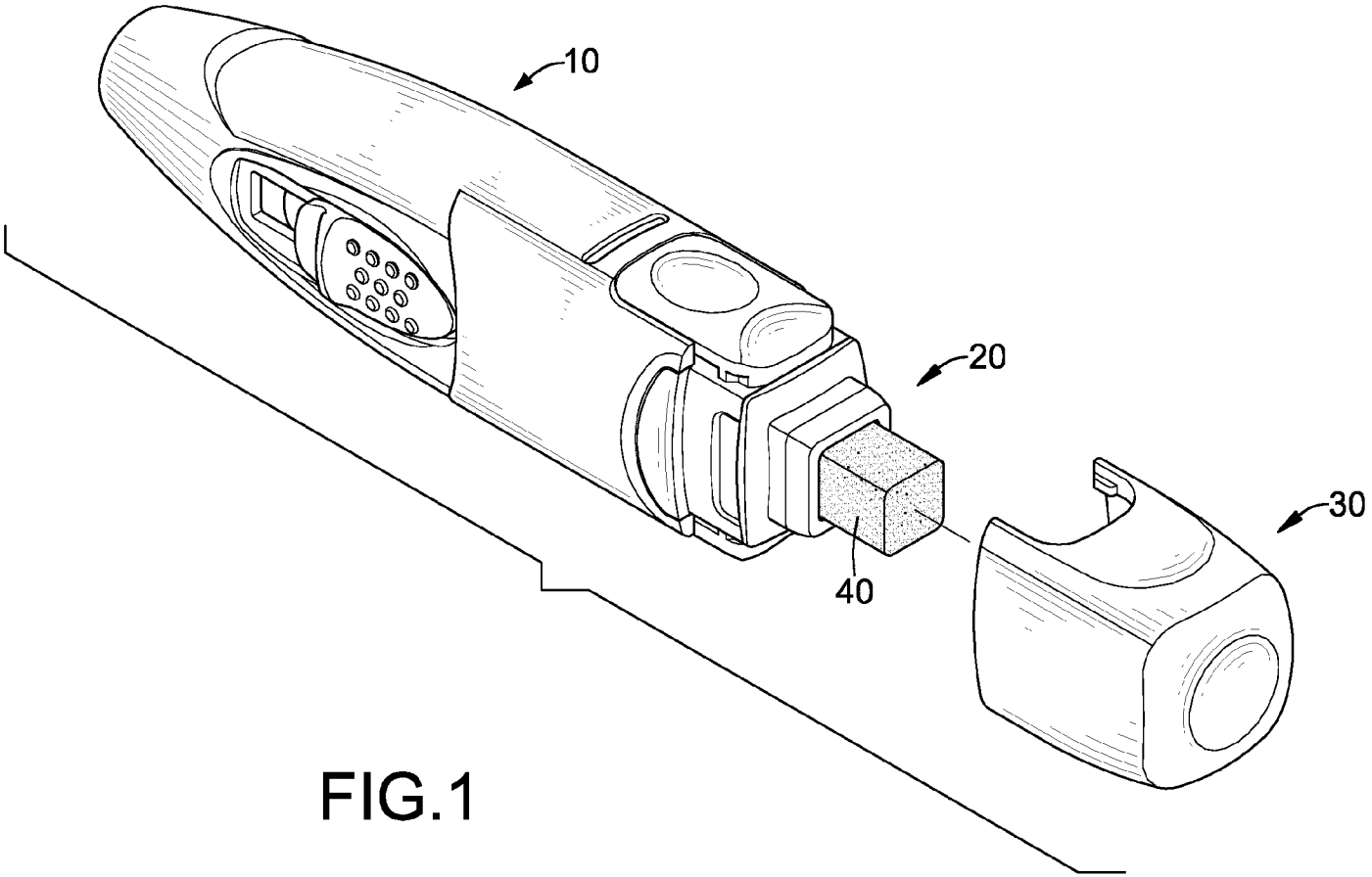
FIG. 1 is an exploded perspective view of a first embodiment of a stationery tool in accordance with the present invention.
Figure 2:
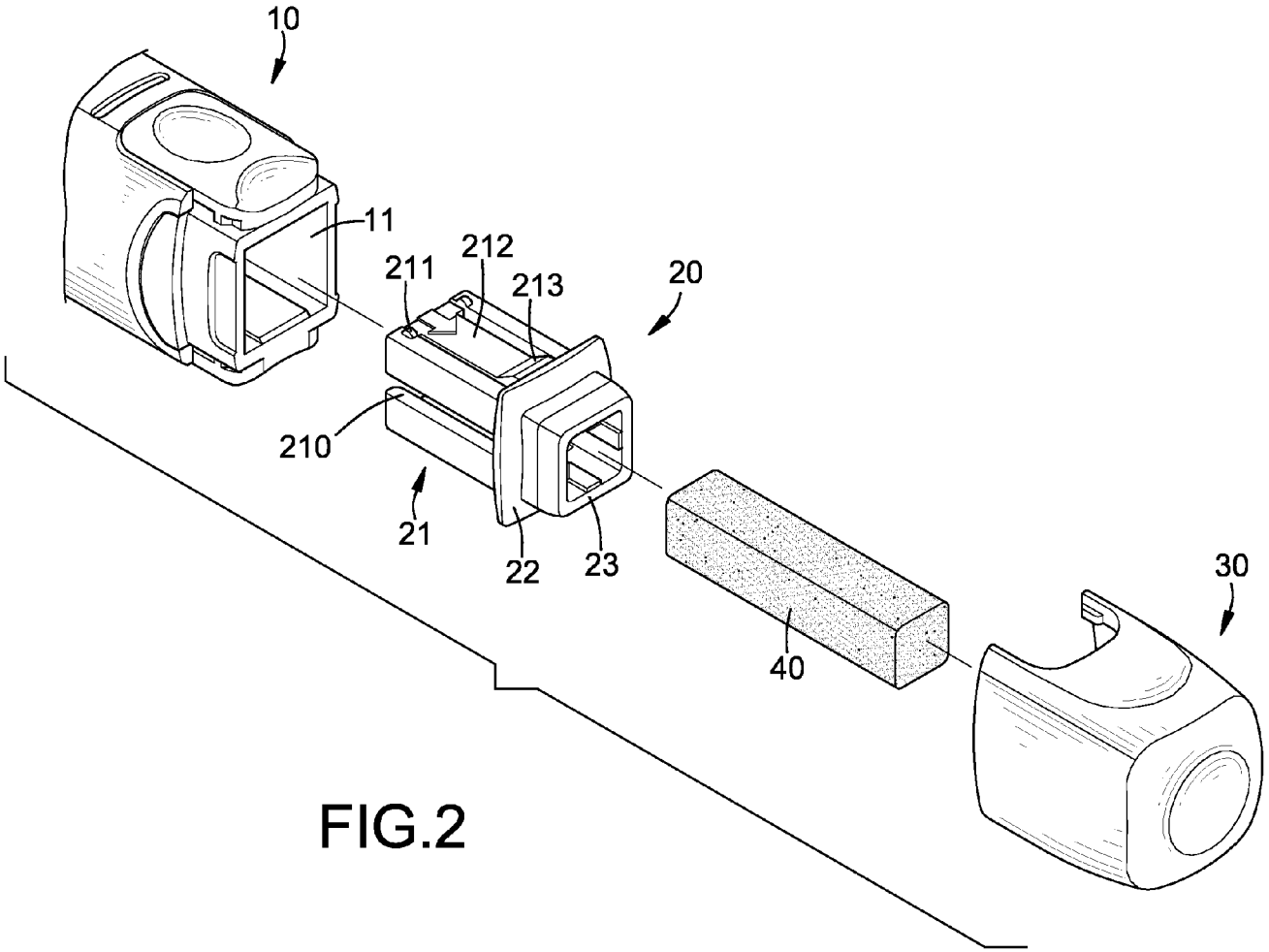
FIG. 2 is an enlarged exploded perspective view of the stationery tool in FIG. 1.
Figure 3:
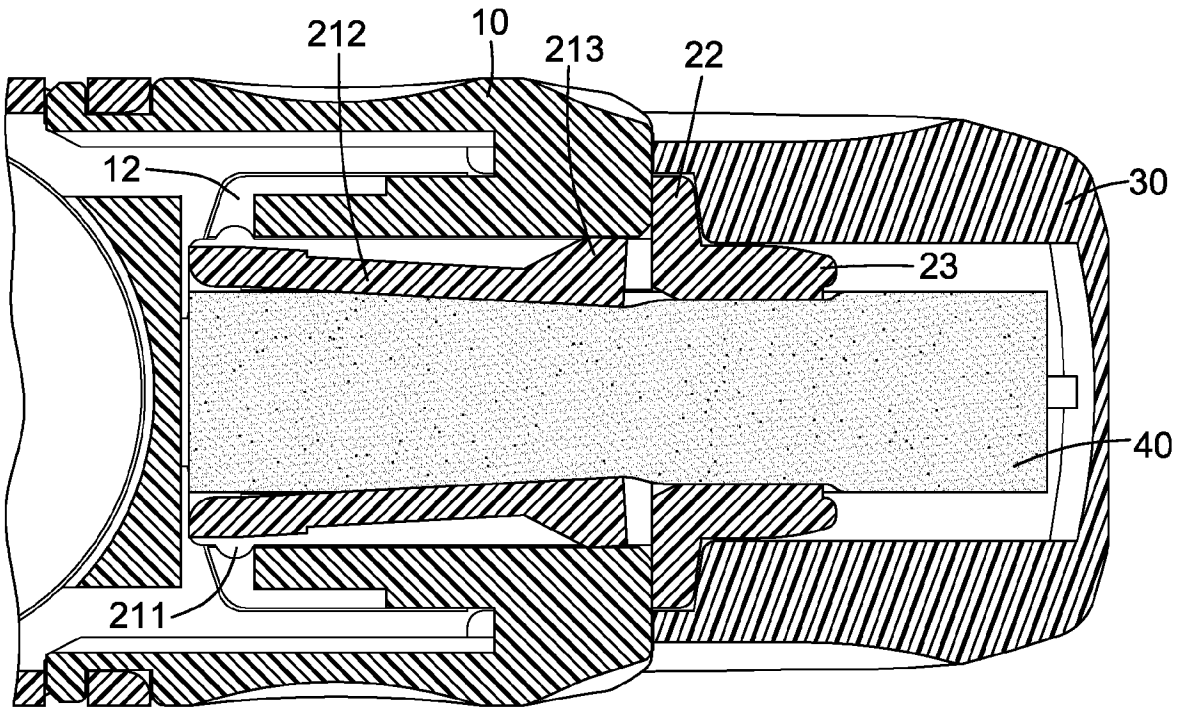
FIG. 3 is an enlarged side view in partial section of the stationery tool in FIG. 1.
Figure 4:
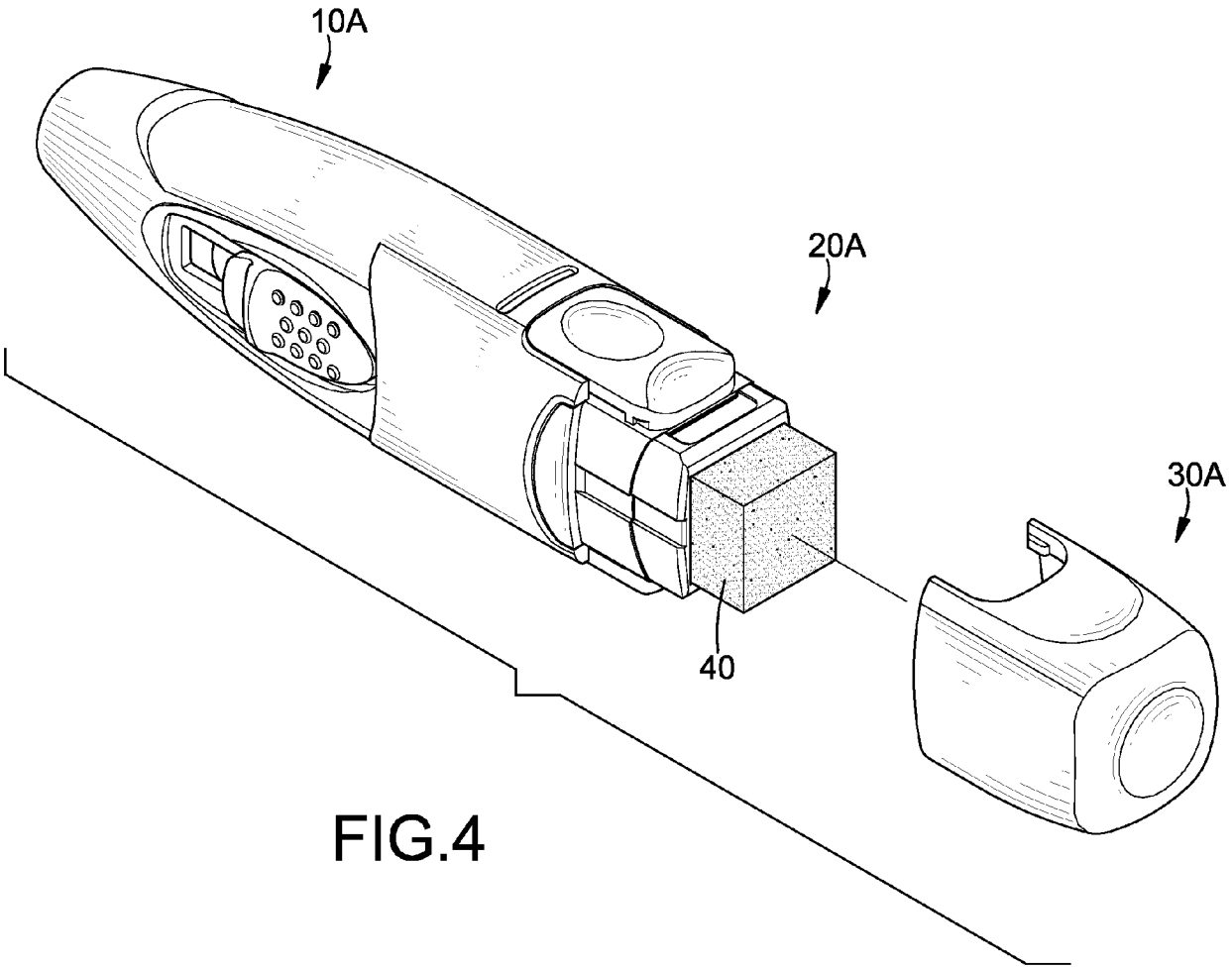
FIG. 4 is an exploded perspective view of a second embodiment of a stationery tool in accordance with the present invention.
Figure 5:
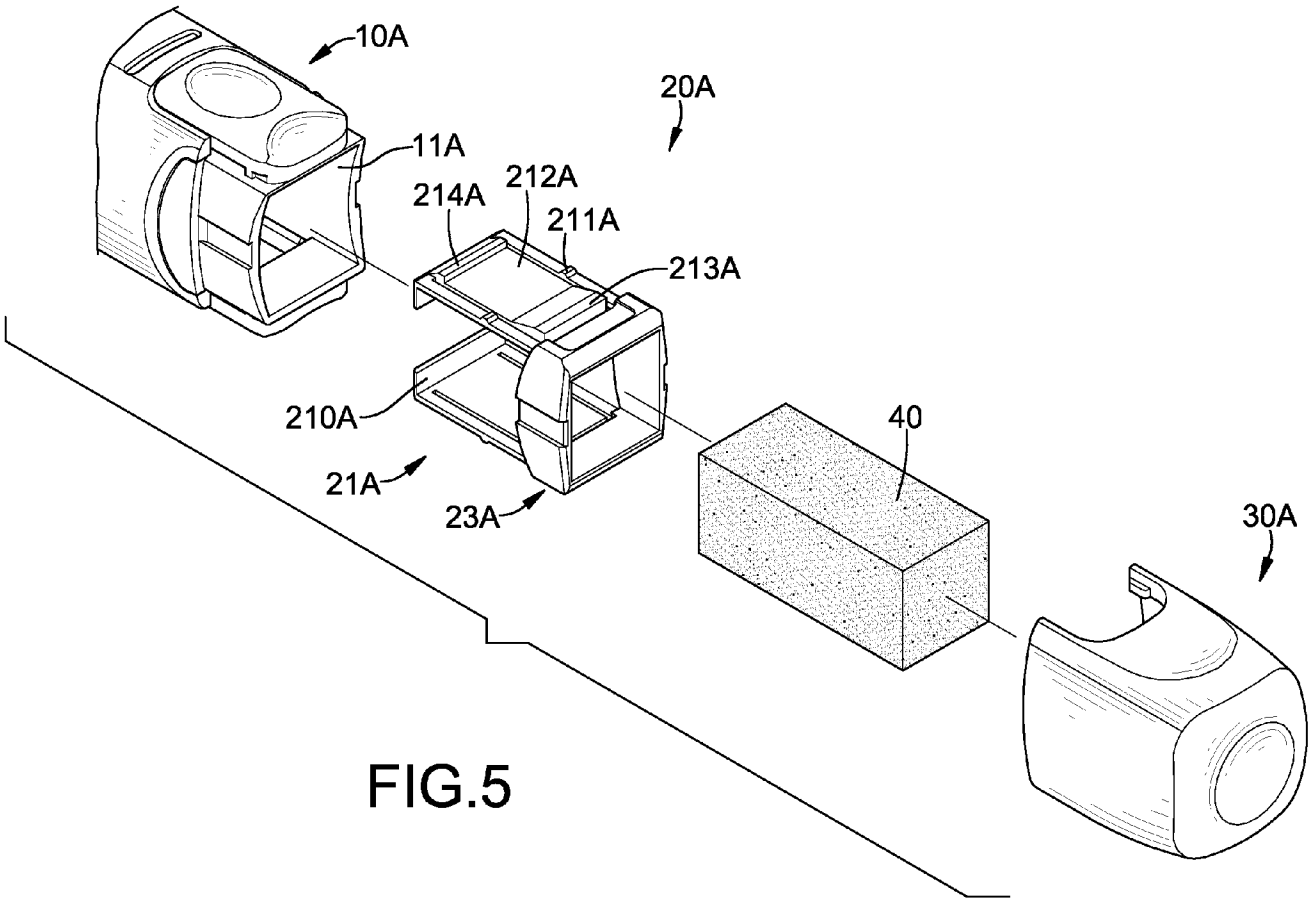
FIG. 5 is an enlarged exploded perspective view of the stationery tool in FIG. 2.
Figure 6:
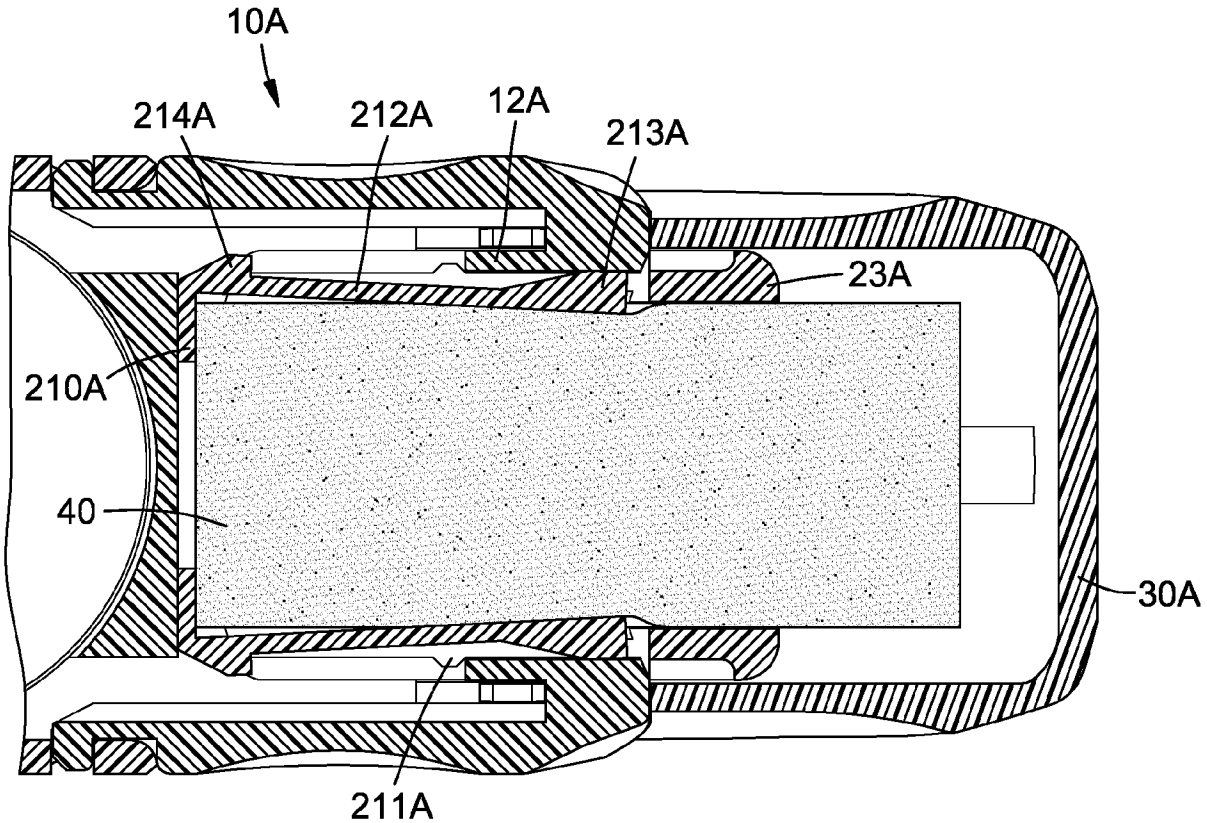
FIG. 6 is an enlarged side view in partial section of the stationery tool in FIG. 2.
Figure 7:
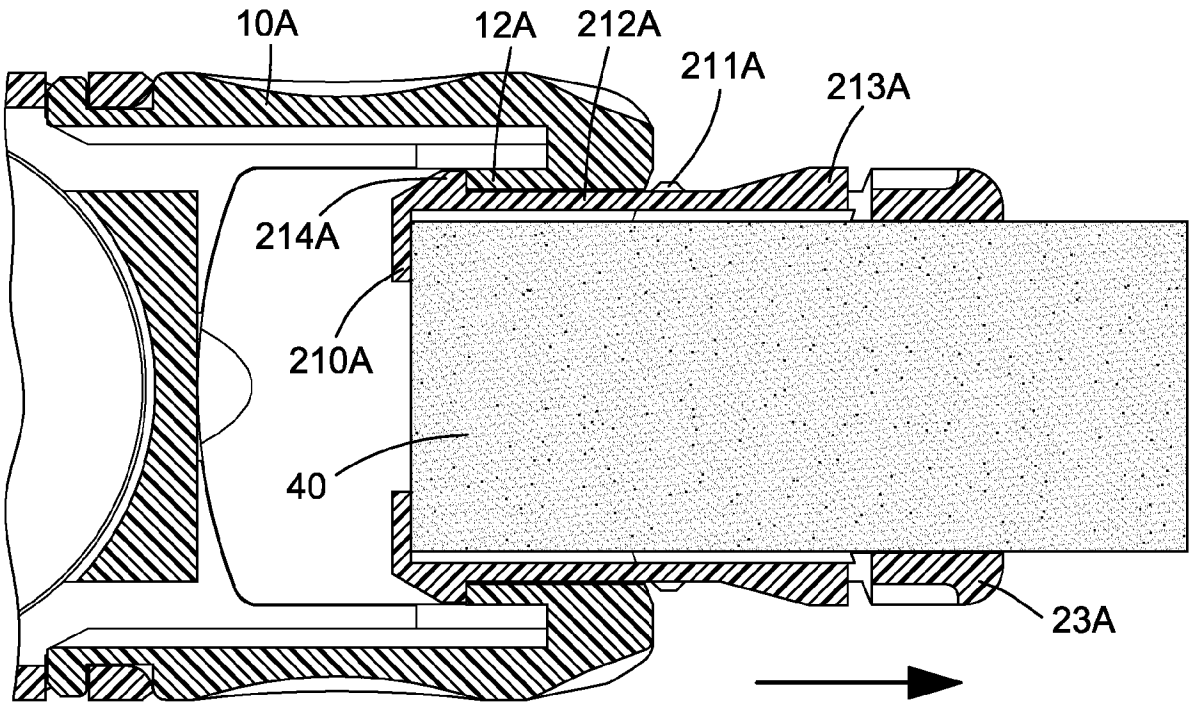
FIG. 7 is an enlarged operational side view in partial section of the stationery tool in FIG. 2 showing the operation of the rubber being replaced.
Figure 8:
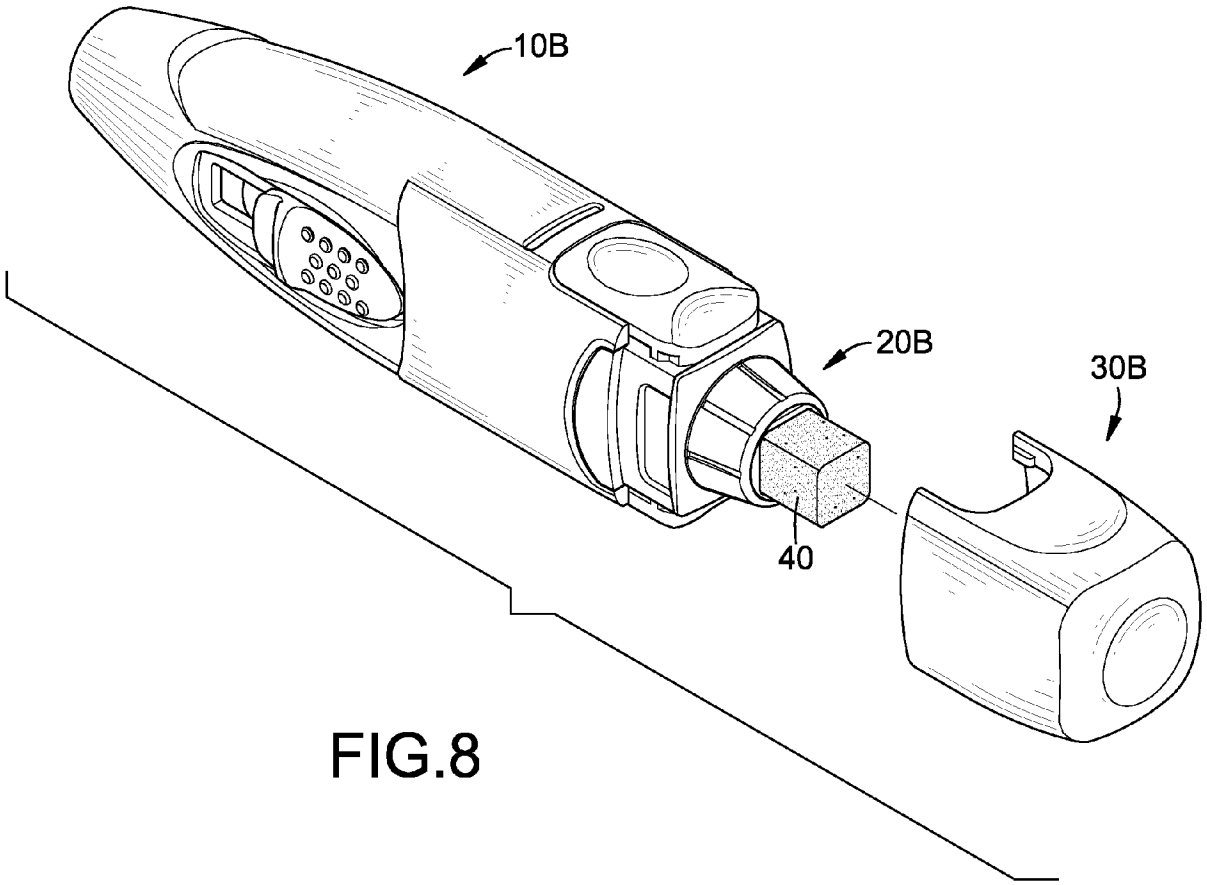
FIG. 8 is an exploded perspective view of a third embodiment of a stationery tool in accordance with the present invention.
Figure 9:
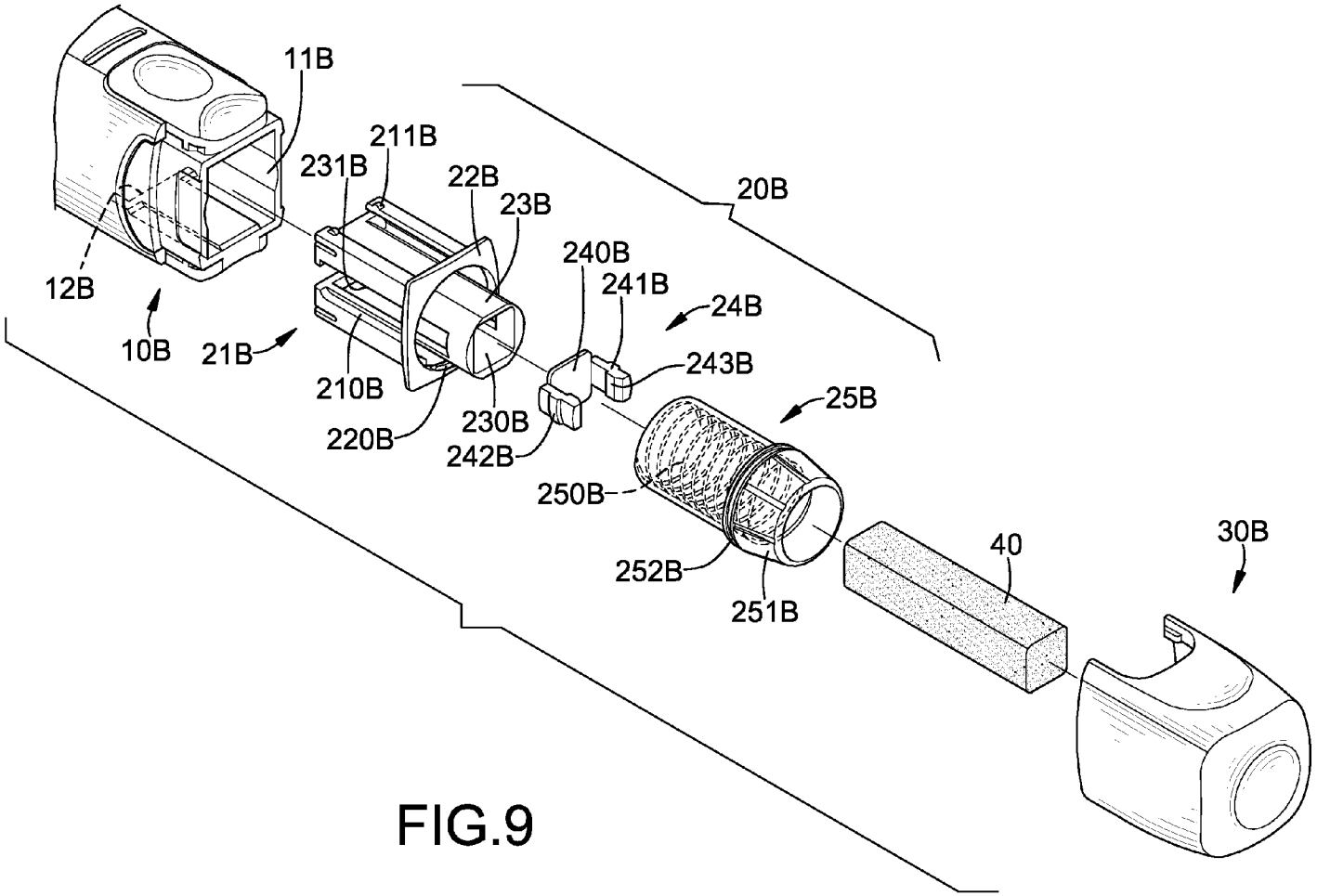
FIG. 9 is an enlarged exploded perspective view of the stationery tool in FIG. 8.
Figure 10:
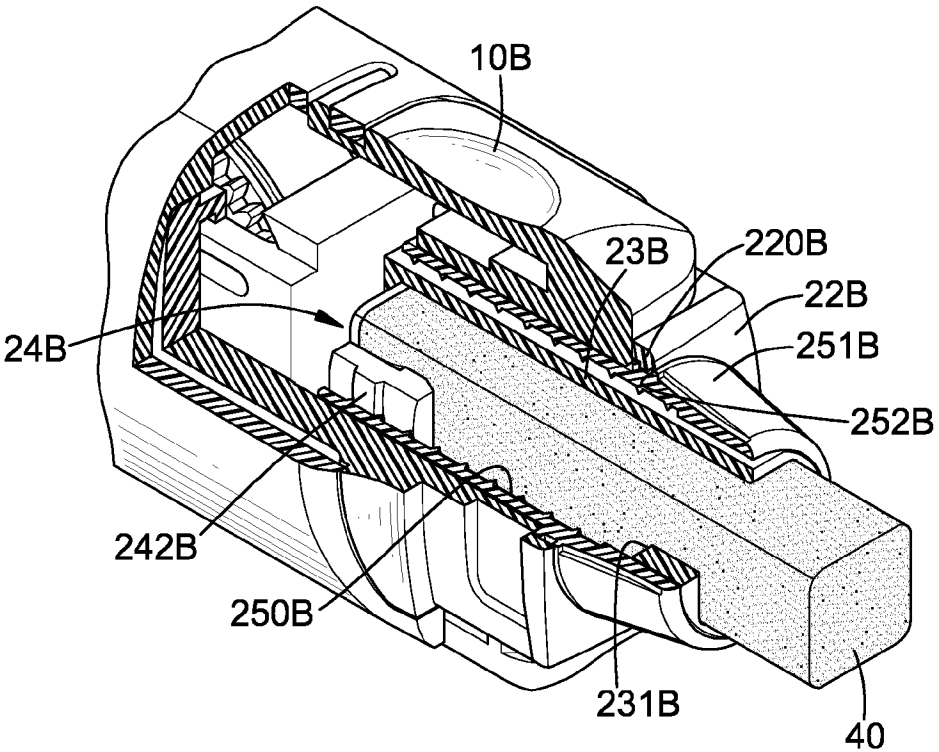
FIG. 10 is an enlarged perspective view in partial section of the stationery tool in FIG. 8.
Figure 11:
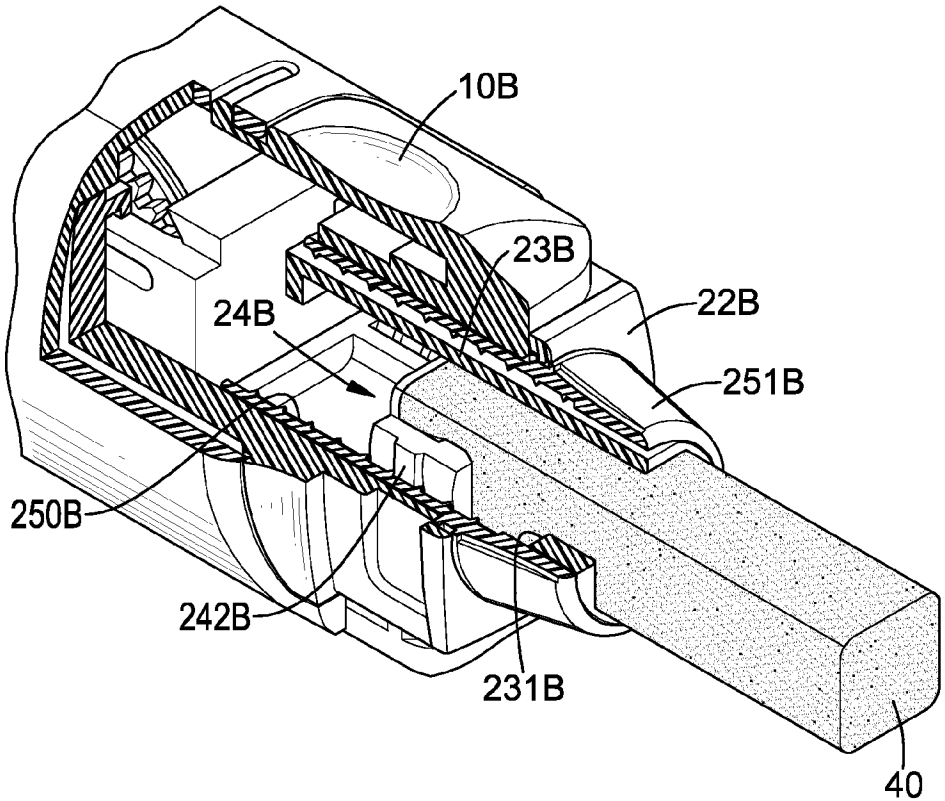
FIG. 11 is an enlarged operational perspective view in partial section of the stationery tool in FIG. 8 showing the rubber being pushed out relative to the body.
Figure 12:
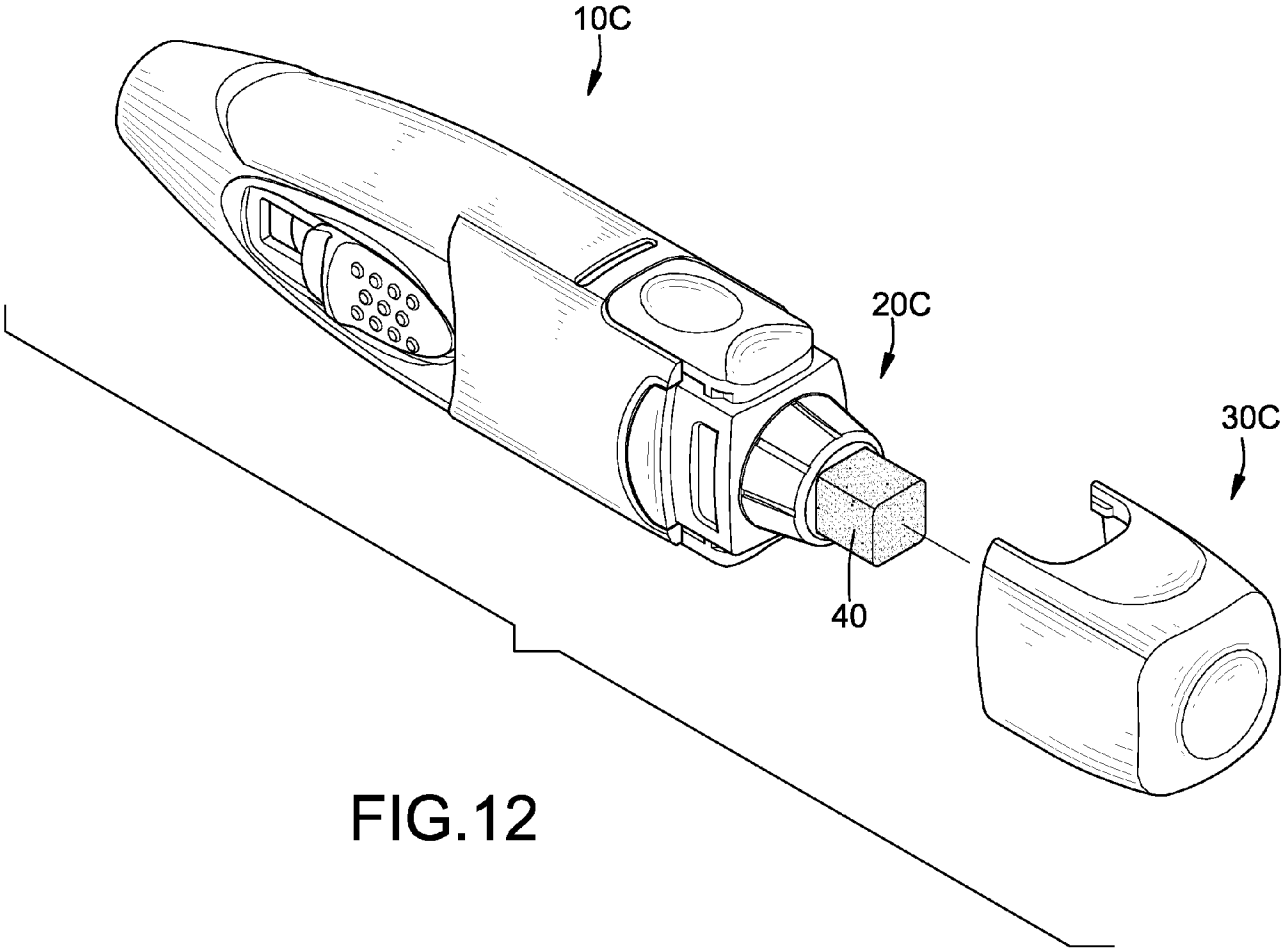
FIG. 12 is an exploded perspective view of a fourth embodiment of a stationery tool in accordance with the present invention.
Figure 13:
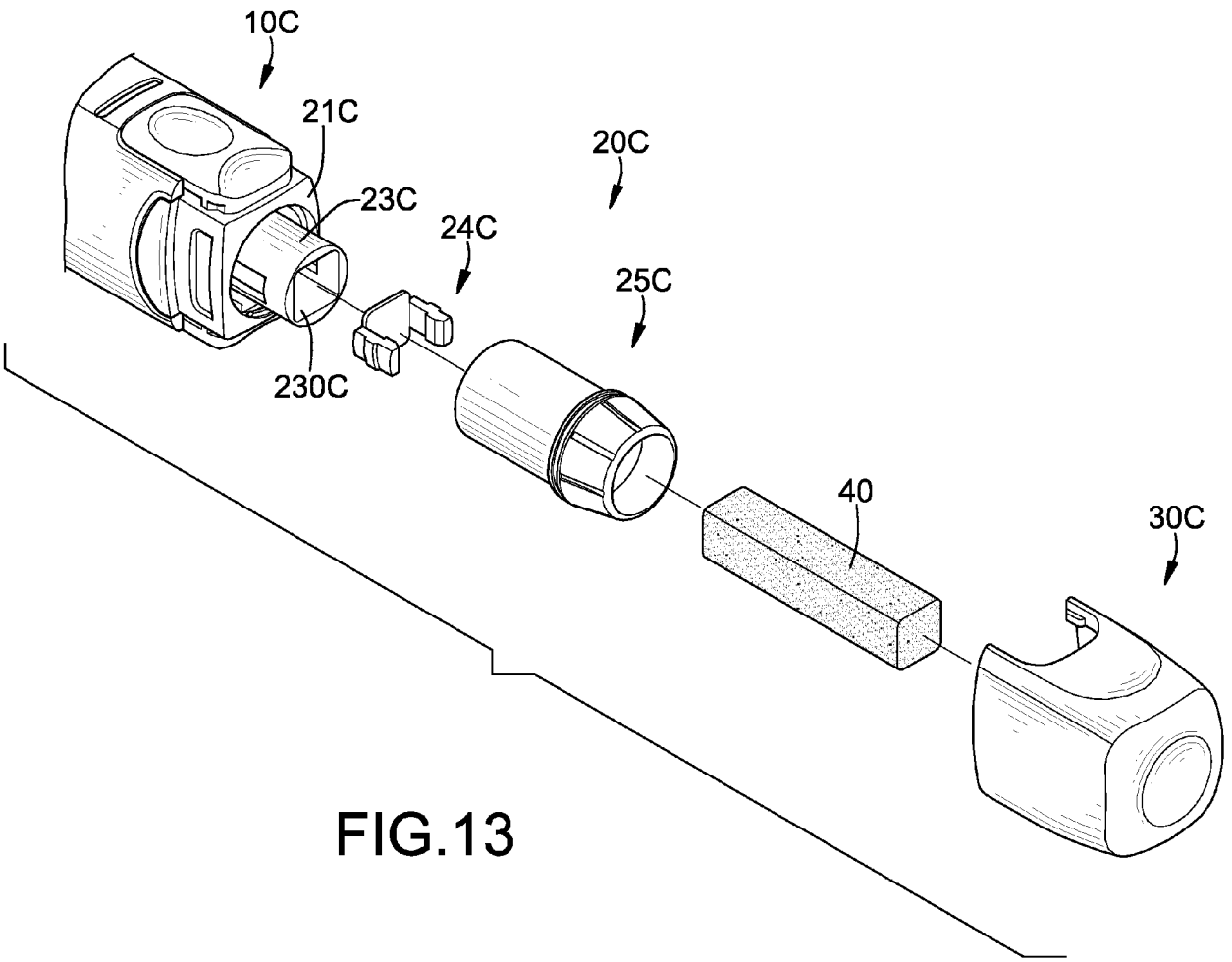
FIG. 13 is an enlarged exploded perspective view of the stationery tool in FIG. 12.
Figure 14:
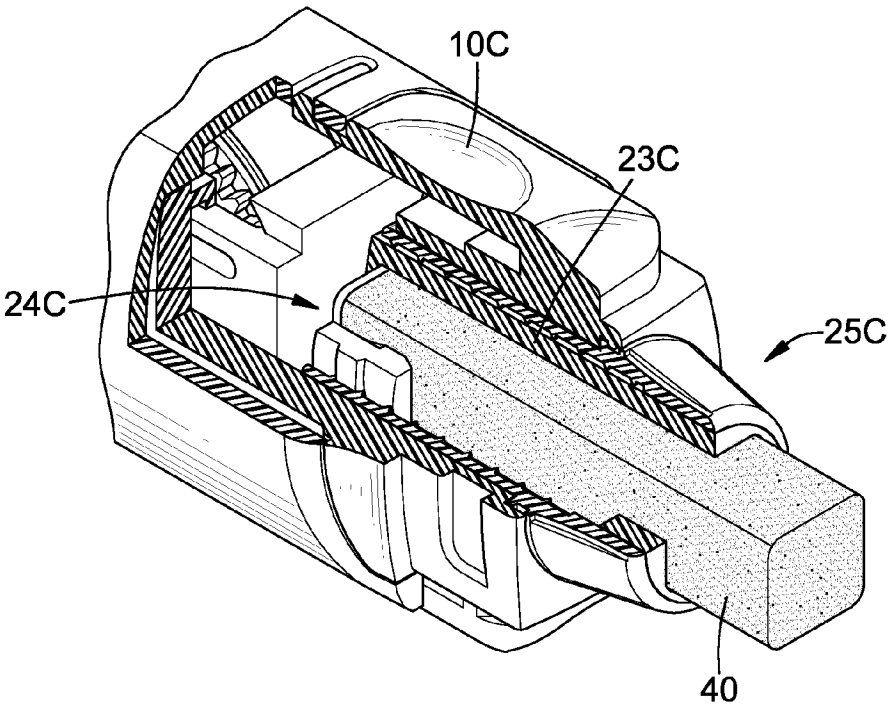
FIG. 14 is an enlarged perspective view in partial section of the stationery tool in FIG. 12.
Figure 15:
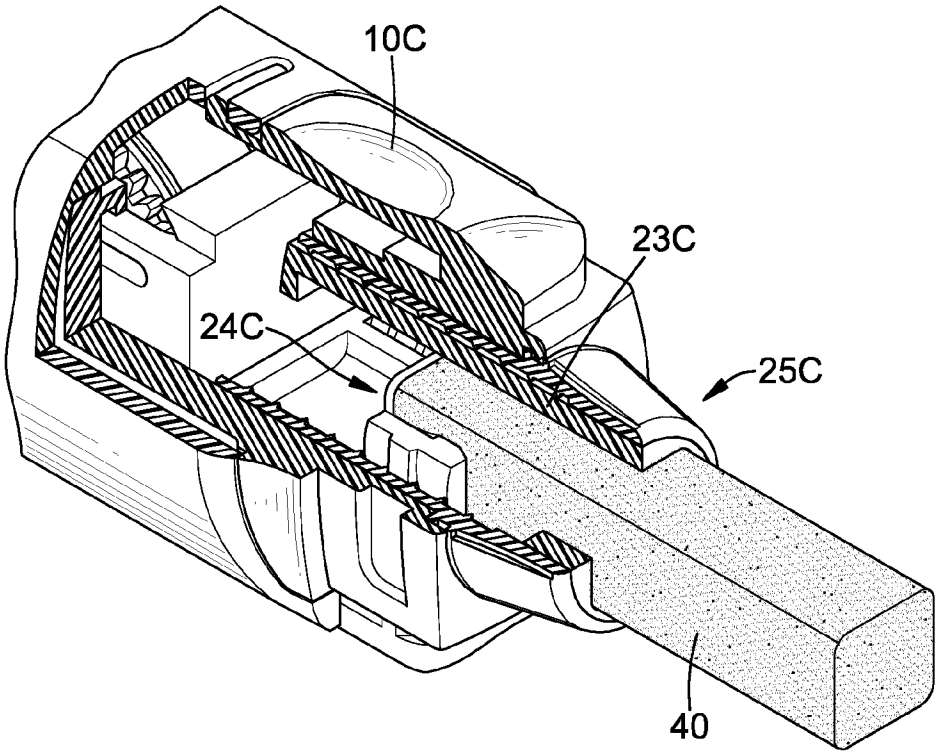
FIG. 15 is an enlarged operational perspective view in partial section of the stationery tool in FIG. 12 showing the rubber being pushed out relative to the body.
Figure 16:
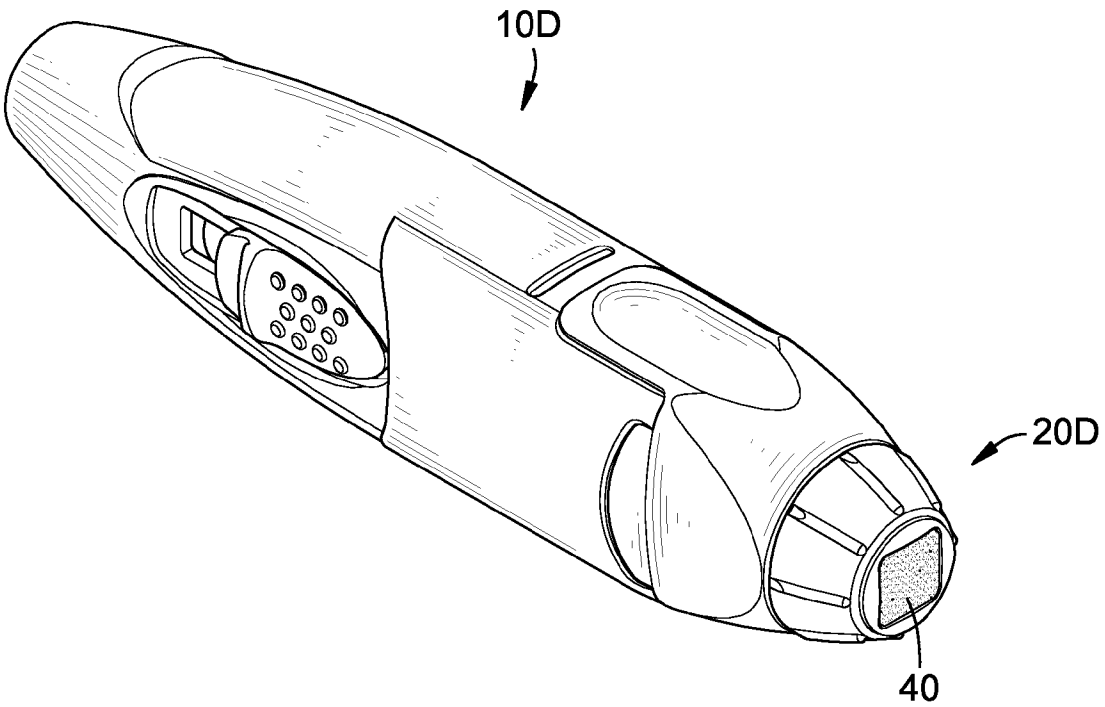
FIG. 16 is an exploded perspective view of a fifth embodiment of a stationery tool in accordance with the present invention.
Figure 17:
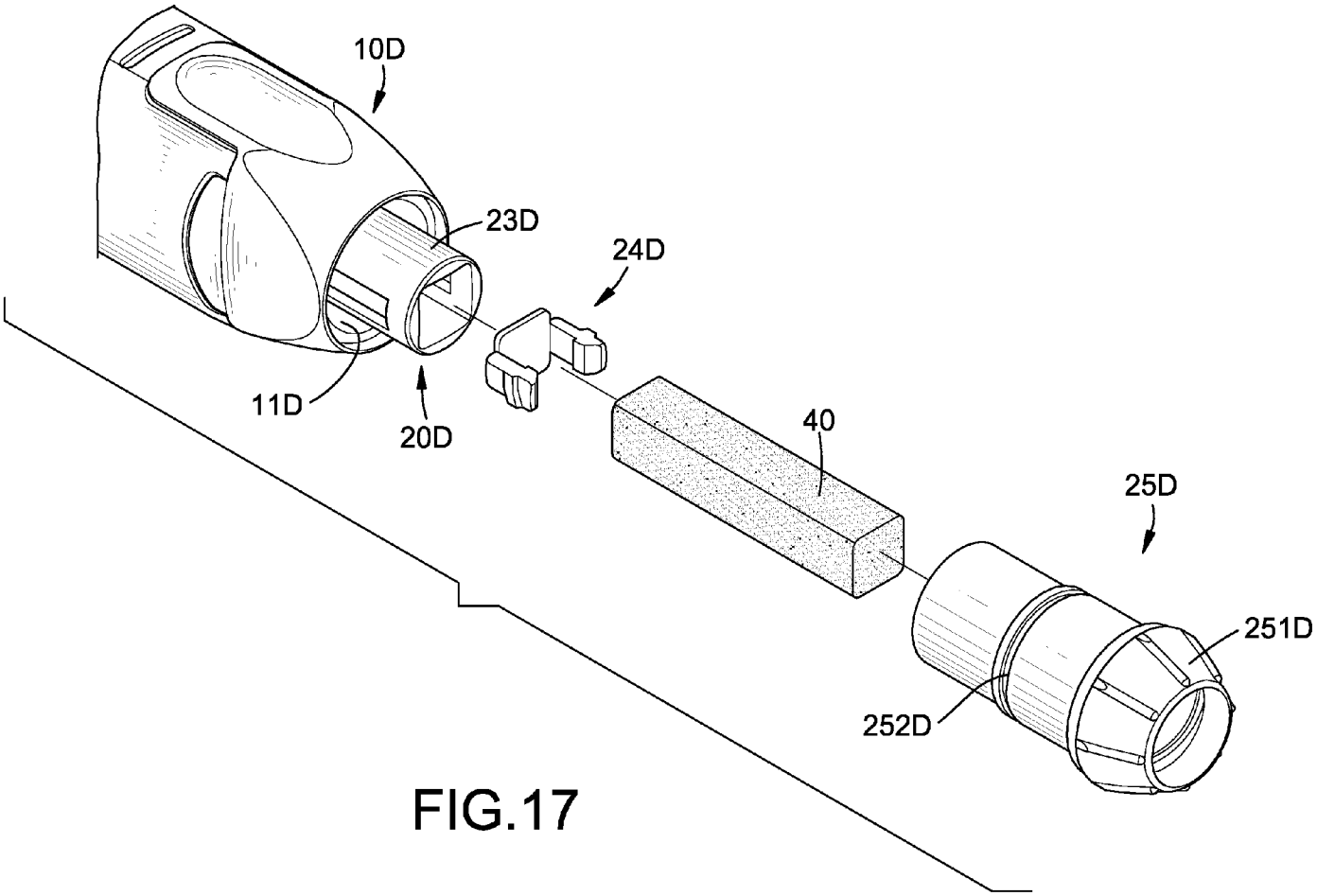
FIG. 17 is an enlarged exploded perspective view of the stationery tool in FIG. 16.
Figure 18:
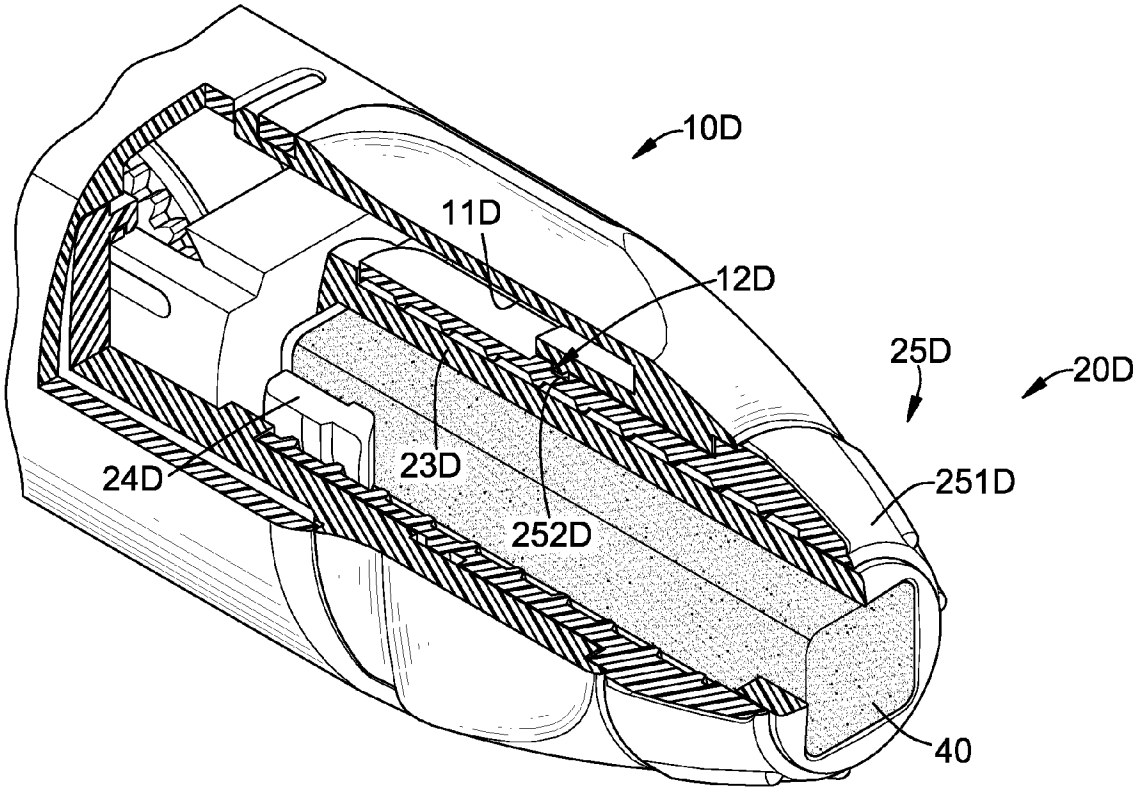
FIG. 18 is an enlarged perspective view in partial section of the stationery tool in FIG. 16.
Figure 19:
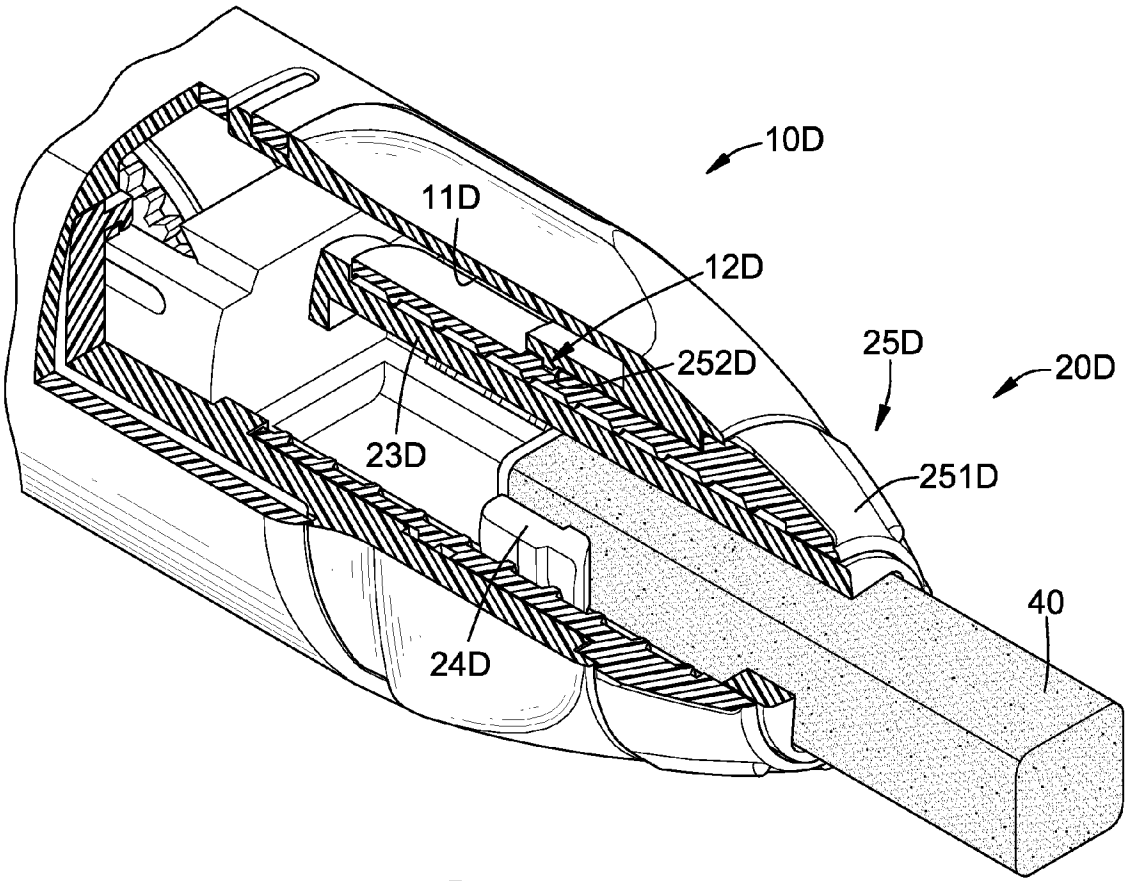
FIG. 19 is an enlarged operational perspective view in partial section of the stationery tool in FIG. 16 showing the rubber being pushed out relative to the body.
Figure 20:
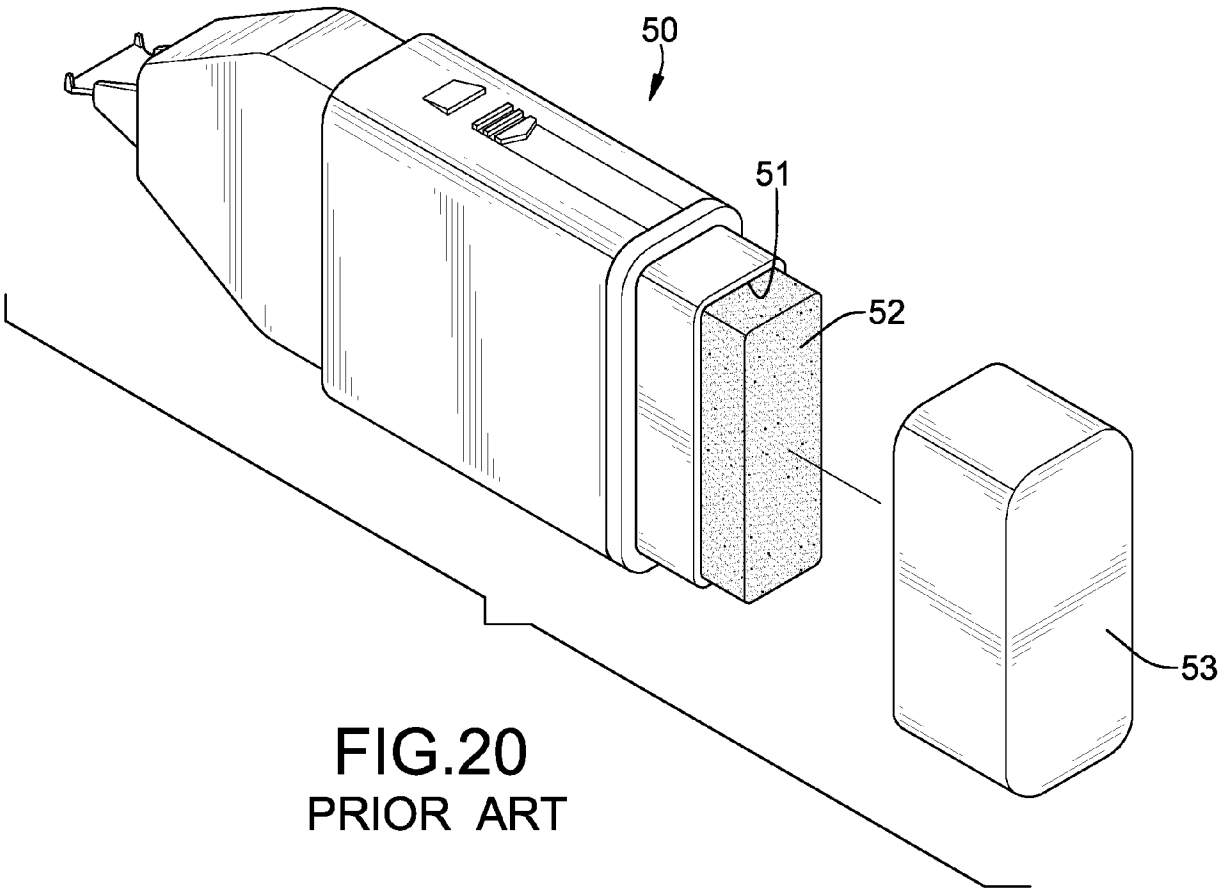
FIG.20 PRIOR ART
FIG. 20 is an exploded perspective view of a conventional correction tape of the '995 patent.

With reference to FIGS. 1 to 3, a first embodiment of a stationery tool in accordance with the present invention comprises a body 10, a rubber holding device 20 and a cap 30.

The body 10 may be a writing tool, a correction tape dispenser, an adhesive tape dispenser or the like, is elongated and comprises a holding end, a stationery functional end and a holding recess 11. The stationery functional end is opposite to the holding end. The holding recess 11 has a mouth defined at the holding end of the body 10 and a first buckling segment 12 formed on the inner surface of the holding recess 11. The first buckling segment 12 is formed on two opposite sides of the inner surface of the holding recess 11 at an inner end opposite to the mouth. The first buckling segment 12 may be implemented as two buckling cavities formed respectively in the opposite sides of the inner surface of the holding recess 11.

The rubber holding device 20 may be a hollow rectangular frame, is mounted detachably on the body 10 and comprises an opening, a clamping segment 21, a stopping flange 22 and a guiding segment 23. The opening is defined in the rubber holding device 20 at a position relative to the holding end of the body 10. Preferably, the opening is defined in one end of the rubber holding device 20 that is outside or inside the holding end of the body 10. The clamping segment 21 is detachably mounted in the holding recess 11 of the body 10 and is slidable between the holding recess 11 and the opening. The clamping segment 21 has an outer end adjacent to the opening and an inner end opposite to the opening. The clamping segment 21 has a resilient slot 210 formed laterally in middle portions of two side walls of the clamping segment 21 to divide the clamping segment 21 into two half clamping frames, such that the half clamping frames have a resilient capability to be pressed toward each other. The clamping segment 21 has a second buckling segment 211 formed on the inner end at the outer sides of the half clamping frames and engaging the first buckling segment 12 on the body 10 to keep the rubber holding device 20 from detaching from the body 10. Preferably, the second buckling segment 211 comprises two buckling bosses respectively formed on and protruding from the inner ends at the outer sides of the half clamping frames.

The clamping segment 21 further comprises two resilient arms 212 formed on the middle portions of the half clamping frames, and each resilient arm 212 has an inner end and an outer end. The inner end is connected integrally with the inner end of the corresponding half clamping frame. The outer end extends outwardly and is provided with a clamping protrusion 213. The clamping protrusion 213 abuts against the inner surface of the holding recess 11 in the body 10 to enable the resilient arm 212 to resiliently protrude into the inner space of the clamping segment 21 for securely clamping the rubber 40.

In addition, the number and structure of the clamping protrusions 213 are not limited in the present invention, and at least three clamping protrusions 213 can be provided by the present invention.

The stopping flange 22 is formed around the outer end of the clamping segment 21 and abuts with the holding end of the body 10 at which the mouth of the holding recess 11 is defined.

The guiding segment 23 may be a rectangular frame, is formed at the outer end of the clamping segment 21 and protrudes outwardly from the stopping flange 22 to make the opening of the rubber holding device 20 have a distance from the clamping segment 21. Accordingly, the rubber 40 can be kept from violently deforming while the rubber 40 is used to wipe writing marks out, from detaching from the clamping segment 21 or from being broken due to the violent deformation.

The cap 30 is mounted detachably on the body 10 at the holding end on which the rubber holding device 20 is mounted, is mounted around the stopping flange 22 and encloses the rubber holding device 20 completely to provide a protection effect to the rubber 40 and to prevent the rubber 40 from being dirtied.

In use, the rubber holding device 20 is drawn out from the body 10, and the stick-typed rubber 40 is inserted into the rubber holding device 20. Then, the rubber holding device 20 with the rubber 40 is inserted into the holding recess 11 in the body 10. With the abutment between the clamping protrusions 213 and the body 10, the resilient arms 212 are pressed toward each other to clamp the inner end of the rubber 40 to securely hold the rubber 40 in position. The middle portion of the rubber 40 is mounted in and abuts with the guiding segment 23, and the outer end of the rubber 40 extends out of the guiding segment 23 to serve as a wiping end. Accordingly, while wiping, the guiding segment 23 of the rubber holding device 20 can keep the rubber 40 from being violently deformed and detached from the clamping segment 21.

In addition, when the extension length of the rubber 40 is not sufficient or is broken or the used rubber 40 has to be replaced with a new one, the rubber holding device 20 is drawn out from the holding recess 11. Then, the rubber 40 can be slid to adjust the extension length of the rubber 40, or the used rubber 40 is drawn out completely from the rubber holding device 20 to be replaced with a new one. Consequently, the rubber holding device 20 with the adjusted or new rubber 40 is inserted into the holding recess 11 for use, so that to adjust or replace the rubber 40 is easy, convenient and quick.

With reference to FIGS. 4 to 7, the second embodiment of the present invention comprises a body 10A, a rubber holding device 20A and a cap 30A. The body 10A has a structure substantially same as that in the first embodiment except that the first buckling segment 12A is two buckling hooks formed respectively on two opposite sides of the inner surface of the holding recess 11A.

The rubber holding device 20A may be a hollow rectangular frame and comprises a clamping segment 21A and a guiding segment 23A. The clamping segment 21A is detachably mounted in the holding recess 11A and comprises two clamping tabs corresponding to each other. Each clamping tab has an inner end and a pressing flange 210A formed on the inner end of the clamping tab and extending toward each other to block and hold the inner end of the rubber 40. A second buckling segment 211A is formed on the middle portions of the clamping tabs and engages the first buckling segment 12A to keep the rubber holding device 20A from sliding relative to the body 10A while inserting the rubber 40 into the rubber holding device 20A. Preferably, the second buckling segment 211A comprises two buckling bosses respectively formed on and protruding from the middle portions at two sides of the clamping tabs.

Each clamping tab further has a resilient arm 212A formed on the clamping tab, and each resilient arm 212A has an inner end and an outer end. The inner end is connected integrally with the clamping tab and has a blocking protrusion 214A laterally formed on the inner end. The outer end extends outwardly and is provided with a lateral clamping protrusion 213A. The clamping protrusion 213A abuts against the inner surface of the holding recess 11A or the first buckling segment 12A to enable the resilient arm 212A to resiliently protrude into the inner space of the clamping segment 21A for securely clamping the rubber 40.

The guiding segment 23A may be a rectangular frame, is formed at the outer end of the clamping segment 21A and is mounted in and protrudes outwardly from the mouth of the holding recess 11A to make the opening of the rubber holding device 20A have a distance from the clamping segment 21A. Accordingly, the rubber 40 can be kept from violently deforming while the rubber 40 is used to wipe writing marks out, from detaching from the clamping segment 21A or from being broken due to the violent deformation.

The cap 30A is mounted detachably on the body 10A at the holding end on which the rubber holding device 20A is mounted, is mounted around the guiding segment 23A and encloses the rubber holding device 20A completely to provide a protection effect to the rubber 40 and to prevent the rubber 40 from being dirtied.

The use of the second embodiment of the present invention is substantially same as that of the first embodiment, but the operation of adjusting or replacing rubber 40 is different and described as follows.

When the extension length of the rubber 40 is not sufficient or is broken or the used rubber 40 has to be replaced with a new one, the rubber holding device 20A is drawn out relative to the holding recess 11A until the blocking protrusions 214A on the clamping tabs engage buckling hooks of the first buckling segment 12A. Accordingly, the rubber holding device 20A can be kept from detaching from the body 10A. At this time, the buckling hooks are held between the blocking protrusions 214A and the buckling bosses of the second buckling segment 211A, and the sliding movement of the rubber holding device 20A is prevented. Meanwhile, the clamping protrusions 213A on the clamping tabs escape from the body 10A, so the clamping protrusions 213A do not clamp onto the rubber 40. Consequently, the clamping force provided by the clamping protrusions 213A and applied to the rubber 40 is dismissed, such that the rubber 40 can be slid for adjusting the extension length of the rubber 40 or for replacing the used rubber 40 with a new one. Consequently, the rubber holding device 20A with the adjusted or new rubber 40 is pushed into the holding recess 11A, and the second buckling segment 211A is reengaged with the first buckling segment 12A. Accordingly, the operation of adjusting or replacing the rubber 40 is completed.

With reference to FIGS. 8 to 11, the third embodiment of the present invention comprises a body 10B, a detachable and rotatable rubber holding device 20B and a cap 30B.

The body 10B has a structure substantially same as that in the first embodiment and further description is omitted.

The rubber holding device 20B is detachably inserted into the holding recess 11B and comprises an outer frame 21B, a stopping flange 22B, a guiding tube 23B, a pushing slider 24B and a rotating knob 25B. The outer frame 21B is mounted detachably in the holding recess 11B and has a resilient slot 210B formed laterally in a middle portion of the outer frame 21B to divide the outer frame 21B into two half frames, such that the half frames have a resilient capability to be pressed toward each other. A second buckling segment 211B is formed on the inner ends at the outer sides of the half frames and engages the first buckling segment 12B on the body 10B to keep the rubber holding device 20B from detaching from the body 10B. Preferably, the second buckling segment 211B comprises two buckling bosses respectively formed on and protruding from the inner ends at the outer sides of the half frames.

The stopping flange 22B may be rectangular and is formed around the outer frame 21B and abuts with the holding end of the body 10B at which the mouth of the holding recess 11B is defined. The stopping flange 22B has an inner surface and a positioning segment formed on the inner surface of the stopping flange 22B. The positioning segment may comprise at least one positioning flange 220B, an annular positioning rib or an annular recess.

The guiding tube 23B is separately mounted in the outer frame 21B to define a separate space between the outer frame 21B and the guiding tube 23B. The guiding tube 23B has an inner end integrally connected to the inner end of the outer frame 21B and an outer end extending out of the outer end of the outer frame 21B and protruding over the stopping flange 22B and out of the body 10B. The guiding tube 23B has an elongated passage 230B defined in the guiding tube 23B for holding the rubber 40 inside and having a rectangular cross section. Two guiding grooves 231B are defined longitudinally and respectively in two opposite sides of the tube wall of the guiding tube 23B. Preferably, the guiding grooves 231B correspond to and align with the resilient slot 210B in the outer frame 21B and extend from the outer end of the guiding tube 23B to a position that passes over the stopping flange 22B.

The pushing slider 24B is mounted slidably in the guiding tube 23B along the guiding grooves 231B to sever as the clamping segment of the rubber holding device 20B and comprises a pushing board 240B and two clamping wings 241B. The pushing board 240B is mounted in and corresponds to the passage 230B of the guiding tube 23B in shape and has two ends. The clamping wings 241B are formed respectively on the ends of the pushing board 240B and are mounted respectively in the guiding grooves 231B in the guiding tube 23B. Each clamping wing 241B has an inner side, an outer side, a thread rib 242B and a clamping protrusion 243B. The thread rib 242B is formed on the outer side of the clamping wing 241B. The clamping protrusion 243B is formed on the inner side of the clamping wing 241B to clamp the inner end of the rubber 40.

The rotating knob 25B may be a circular hollow tube, is mounted rotatably around the guiding tube 23B and is mounted in the outer frame 21B. The rotating knob 25B further has an inner thread 250B and a head 251B. The inner thread 250B is formed in the inner surface of the rotating knob 25B and engages the thread ribs 242B on the clamping wings 241B. The head 251B is formed on the outer end of the rotating knob 25B and abuts with the stopping flange 22B to enable the rotating knob 25B to be rotated and to drive the pushing slider 24B to move along the guiding tube 23B so as to adjust the extension length of the rubber 40. Preferably, the rotating knob 25B has an engaging segment formed on the outer surface of the rotating knob 25B and rotatably engaging the positioning segment on the stopping flange 22B. The engaging segment may be an annular recess 252B corresponding to and engaging the at least one positioning flange 220B or annular positioning rib of the positioning segment, or may comprise at least one positioning flange or an annular positioning rib corresponding to and engaging the annular recess of the positioning segment. Accordingly, the rotating knob 25B is rotatably mounted on the stopping flange 22B.

The cap 30B has a structure same as that of the first embodiment and detail description is omitted.

In use, the stick-typed rubber 40 is inserted into the passage 230B in the guiding tube 23B, and the inner end of the rubber 40 abuts against the pushing board 240B of the pushing slider 24B and is clamped by the clamping protrusions 243B on the clamping wings 241B. The outer end of the rubber 40 extends out of the rotating knob 25B to serve as a wiping end, and the middle portion of the rubber 40 is held and limited by the tube wall of the guiding tube 23B. Accordingly, the rubber 40 can be kept from being violently deformed and detached from the rubber holding device 20B.

When the extension length of the rubber 40 is not sufficient or the rubber 40 is broken or the used rubber 40 has to be replaced with a new one, the head 251B of the rotating knob 25B is rotated and the pushing slider 24B is moved along the guiding grooves 231B in the guiding tube 23B with the engagement between the inner thread 250B and the thread ribs 242B on the clamping wings 241B. Accordingly, the rubber 40 can be pushed to extend out of the opening of the rubber holding device 20B for an appropriate extension length. To replace the used rubber 40 with a new one, the head 251B is rotated until the pushing slider 24B moves to a position adjacent to the opening of the rubber holding device 20B. Then, the used rubber 40 can be detached from the rubber holding device 20B and a new rubber 40 can be inserted into the rubber holding device 20B.

When the head 251B of the rotating knob 25B is rotated in reverse, the pushing slider 24B with the rubber 40 will be moved into the guiding tube 23B along the guiding grooves 231B with the engagement between the inner thread 250B and the thread ribs 242B on the clamping wings 241B. Accordingly, the extension length of the rubber 40 can be conveniently adjusted by rotating the head 251B.

With reference to FIGS. 12 to 15, the fourth embodiment of the present invention comprises an undetachable but rotatable rubber holding device 20C and has a structure substantially same as that of the third embodiment except that the outer frame 21C and the guiding tube 23C of the rubber holding device 20C are integrally formed in the body 10C and the stopping flange is omitted. The cap 30C is mounted detachably on the body 10C to completely enclose the rubber holding device 20C. Alternatively, the outer frame and the stopping flange can also be omitted, and the guiding tub 23C is separately mounted in the body 10C. The pushing slider 24C is moveably mounted in the passage 230C in the guiding tube 23C, and the rotating knob 25C is mounted rotatably around the guiding tube 23C and is mounted between the body 10C and the guiding tube 23C. The use and operation of the fourth embodiment are substantially same as those of the third embodiment and detail description is omitted.

With reference to FIGS. 16 to 19, the fifth embodiment of the present invention comprises an undetachable but rotatable rubber holding device 20D and has a structure substantially same as that of the fourth embodiment.

The holding recess 11D of the body 10D has a bottom protruding laterally from a side wall of the body 10D, and a positioning segment is formed on the inner surface of the holding recess. The positioning segment may comprise at least one positioning flange 12D, an annular positioning rib or an annular recess.

The guiding tube 23D has an inner end integrally connected to the bottom of the holding recess 11D and an outer end extending out of the holding recess 11D. The pushing slider 24D is mounted in the guiding tube 23D, and the rotating knob 25D is rotatably mounted around the guiding tube 23D and mounted between the guiding tube 23D and the body 10D. Preferably, the rotating knob 25D has an engaging segment formed on the outer surface at the middle portion of the rotating knob 25D and rotatably engaging the positioning segment in the body 10D. The engaging segment may be an annular recess 252D corresponding to and engaging the at least one positioning flange 12D or annular positioning rib of the positioning segment, or may comprise at least one positioning flange or an annular positioning rib corresponding to and engaging the annular recess of the positioning segment. Accordingly, the rotating knob 25D is rotatably connected with the inner surface of the holding recess 11D. In the fifth embodiment, the outer frame and the stopping flange are omitted.

The use of the fifth embodiment is substantially same as that of the fourth embodiment. When the rotating knob 25D is rotated, the pushing slider 24D is driven to move along the guiding tube 23D so as to extend or retract the rubber 40 out of or into the body 10D. Because the rubber 40 can be retracted completely into the body 10D, the cap can be omitted.

With the above description, the rubber holding device 20 in accordance with the present invention has capabilities of adjusting an extension length of the rubber 40 relative to the body 10 and conveniently replacing the rubber 40. The rubber 40 can be pushed to extend out of the body 10 for use and can be retracted completely after wiping, so the use of the rubber 40 is convenient and versatile. As to replacement, the rubber 40 can be easily replaced by drawing the rubber holding device 20 out from the body 10 or rotating the rotating knob 25, and this is convenient in operation.

In addition, because the rubber holding device 20 has a clamping segment 21 and a guiding segment 23, the rubber 40 can be securely clamped by the clamping segment 21 to prevent the rubber 40 from detaching from the body 10. The guiding segment 23 can keep the rubber 40 from being violently deformed during wiping and has capabilities of preventing the rubber 40 from detaching from the body 10 and of absorbing the deformation of the rubber 40.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stationery tool comprising:

a body having a holding end;

a stationery functional end opposite to the holding end; and a holding recess defined in the holding end of the body;

a rubber holding device mounted in the holding recess of the body for holding a rubber to adjust an extension length of the rubber relative to the body and comprising an opening defined in the rubber holding device at a position relative to the holding end of the body; and a clamping segment slidably mounted in the holding recess of the body, being slidable between the holding recess and the opening of the rubber holding device to adjust the extension length of the rubber relative to the body and comprising multiple clamping protrusions for pressing against the rubber; and a rotating knob mounted rotatably on the rubber holding device, wherein the holding recess has an inner surface and a positioning segment formed on the inner surface of the holding recess; and the rotating knob has an engaging segment formed on an outer surface of the rotating knob and rotatably engaging the positioning segment in the holding recess.

2. The stationery tool as claimed in claim 1, wherein the rubber holding device further comprises a guiding tube having an elongated passage for holding the rubber inside; and at least one guiding groove defined longitudinally in a tube wall of the guiding tube;

a pushing slider mounted slidably in the guiding tube along the at least one guiding groove to serve as the clamping segment of the rubber holding device, wherein the clamping protrusions are formed on the pushing slider; and the rotating knob is mounted rotatably around the guiding tube and is connected to and drives the pushing slider to move.

3. The stationery tool as claimed in claim 2, wherein the guiding tube has two guiding grooves formed respectively in two opposite sides of the tube wall of the guiding tube; and the rubber holding device has two clamping protrusions formed respectively on two ends of the pushing slider.

4. The stationery tool as claimed in claim 3, wherein the pushing slider further has two thread ribs formed respectively on the ends of the pushing slider and respectively mounted in the guiding grooves in the guiding tube; and the rotating knob further has an inner thread formed in an inner surface of the rotating knob and engaging the thread ribs on the pushing slider; and a head formed on an outer end of the rotating knob to enable the rotating knob to be rotated and to drive the pushing slider to move along the guiding tube so as to adjust the extension length of the rubber.

5. The stationery tool as claimed in claim 4, wherein the guiding tube has a guiding segment extending axially and outwardly from the guiding tube to make an end of the guiding segment have a distance from the clamping segment.

6. The stationery tool as claimed in claim 4, wherein the pushing slider comprises a pushing board mounted in the passage of the guiding tube and having two ends; and two clamping wings formed respectively on the ends of the pushing board and mounted respectively in the guiding grooves in the guiding tube, and each clamping wing having an inner side and an outer side;

the clamping protrusions are formed respectively on the inner sides of the clamping wings of the pushing slider; and the thread ribs are formed respectively on the outer sides of the clamping wings of the pushing slider.

7. The stationery tool as claimed in claim 6, wherein the rubber holding device further has an outer frame mounted around the guiding tube and having an inner end and an outer end;

the guiding tube is separately mounted in the outer frame and has an inner end connected to the inner end of the outer frame; and an outer end extending out of the outer end of the outer frame; and the rotating knob is mounted between the guiding tube and the outer frame.

8. The stationery tool as claimed in claim 6, wherein the holding recess has a bottom;

the guiding tube has an inner end connected to the bottom of the holding recess; and the rotating knob is mounted between the guiding tube and the body.

9. The stationery tool as claimed in claim 2, wherein the rubber holding device further has an outer frame mounted around the guiding tube and having an inner end and an outer end;

the guiding tube is separately mounted in the outer frame and has an inner end connected to the inner end of the outer frame; and an outer end extending out of the outer end of the outer frame; and the rotating knob is mounted between the guiding tube and the outer frame.

10. The stationery tool as claimed in claim 9, wherein the outer frame has a stopping flange formed around the outer end of the outer frame and abutting with a mouth of the holding recess;

the stopping flange has an inner surface and a positioning segment formed on the inner surface of the stopping flange; and the rotating knob has an engaging segment formed on an outer surface of the rotating knob and rotatably engaging the positioning segment on the stopping flange of the outer frame.

11. The stationery tool as claimed in claim 10, wherein the positioning segment comprises at least one positioning flange; and the engaging segment comprises an annular recess mounted around the at least one positioning flange.

12. The stationery tool as claimed in claim 10, wherein the holding recess in the body has an inner surface and a first buckling segment formed on the inner surface of the holding recess; and the outer frame has a second buckling segment formed on the inner end of the outer frame and engaging the first buckling segment.

13. The stationery tool as claimed in claim 12, wherein the outer frame has a resilient slot formed laterally in a middle portion of the outer frame to divide the outer frame into two half frames.

14. The stationery tool as claimed in claim 2, wherein the holding recess has a bottom;

the guiding tube has an inner end connected to the bottom of the holding recess; and the rotating knob is mounted between the guiding tube and the body.

15. The stationery tool as claimed in claim 1, wherein the positioning segment comprises at least one positioning flange; and the engaging segment comprises an annular recess mounted around the at least one positioning flange.

* * * * *